US008615897B2

(12) United States Patent
Wehrheim et al.

(10) Patent No.: US 8,615,897 B2
(45) Date of Patent: Dec. 31, 2013

(54) DRYER MOTOR AND CONTROL

(75) Inventors: Robert E. Wehrheim, Wentzville, MO (US); Keith I. Hoemann, Fenton, MO (US); Gregory A. Peterson, South Barrington, IL (US); L. Ranney Dohogne, Creve Coeur, MO (US); Marshall J. Huggins, Kirkwood, MO (US); Gregory M. Levine, St. Louis, MO (US)

(73) Assignee: Nidec Motor Corporation, St. Louis, MO (US)

( * ) Notice: Subject to any disclaimer, the term of this patent is extended or adjusted under 35 U.S.C. 154(b) by 406 days.

(21) Appl. No.: 12/504,568

(22) Filed: Jul. 16, 2009

(65) Prior Publication Data

US 2011/0010961 A1 Jan. 20, 2011

(51) Int. Cl.
*F26B 21/06* (2006.01)

(52) U.S. Cl.
USPC ..... 34/546; 34/547; 34/601

(58) Field of Classification Search
USPC ..... 34/595, 599, 601, 546, 547; 310/75 R; 318/739, 800, 807, 400.3
See application file for complete search history.

(56) References Cited

U.S. PATENT DOCUMENTS

| | | | | |
|---|---|---|---|---|
| 3,072,386 | A | 1/1963 | Horecky | |
| 3,309,783 | A * | 3/1967 | Worst | 34/553 |
| 3,546,786 | A | 12/1970 | Jacobs | |
| 4,112,767 | A | 9/1978 | Bochan | |
| 4,649,654 | A * | 3/1987 | Hikino et al. | 34/493 |
| 4,665,628 | A | 5/1987 | Clawson | |
| 4,669,199 | A | 6/1987 | Clawson et al. | |
| 4,689,896 | A | 9/1987 | Narang | |
| 4,891,892 | A | 1/1990 | Narang | |
| 5,345,156 | A * | 9/1994 | Moreira | 318/400.04 |
| 6,745,495 | B1 | 6/2004 | Riddle et al. | |
| 7,017,280 | B2 | 3/2006 | Green et al. | |
| 2006/0152178 | A1 | 7/2006 | Carow | |
| 2007/0220776 | A1 * | 9/2007 | Guinibert et al. | 34/603 |
| 2007/0256321 | A1 * | 11/2007 | Bae et al. | 34/562 |
| 2010/0256821 | A1 * | 10/2010 | Jeung et al. | 318/504 |

* cited by examiner

*Primary Examiner* — Jiping Lu
(74) *Attorney, Agent, or Firm* — Maginot, Moore & Beck, LLP

(57) ABSTRACT

A drying device has been developed having a single electric motor configured to drive a drum and directly drive an air blower. The single electric motor is a non-line frequency electric motor. The drum is coupled to a support frame to enable rotation of the drum relative the support frame. The drum has an interior space for holding a load of articles, such as clothing. The motor includes a controller configured to increase gradually the angular velocity of the drum to provide a "soft start" for the dryer.

5 Claims, 5 Drawing Sheets

DRYER MOTOR AND CONTROL

TECHNICAL FIELD

The apparatus and method described below relate to laundry appliances and, more specifically, to a clothes drying machine.

BACKGROUND

Clothes drying machines, referred to as clothes dryers, dry damp clothing by circulating heated air among the clothing. Often, clothes dryers include a drum in which a load of damp clothing is placed. During a drying cycle, an electric motor rotates the drum and a blower circulates heated air among the clothing as the clothing tumbles within the drum. The drying cycle may continue until the expiration of a predetermined time period or until a control system determines that the clothing is substantially dry.

The electric motor coupled to the drum includes an output shaft having a fixed angular velocity or rotational speed. The rotation of the output shaft is typically coupled at one end to the drum, through a transmission system, to cause the drum to have an angular velocity suitable for most clothes drying situations, and at another end to an air blower that forces an air flow through the drum. In particular, if the drum is rotated too quickly the clothes within the drum may become forced against the sides of the drum instead of tumbling within the drum. Additionally, if the drum is rotated too slowly the clothes within the drum may remain grouped together, and prevent the heated air from flowing among the clothing sufficiently to dry the clothing. Therefore, the electric motor is chosen with reference to its angular velocity to produce an angular velocity for the drum at which an average load of damp clothing is dried within a reasonable time. The angular velocity of the motor output shaft, however, may not drive the air blower at an angular velocity, which produces a preferred amount of air flow, as explained below.

The air blower, or blower, often includes a fan mounted within a housing. When the fan is rotated within the housing, air is drawn into a housing inlet and expelled through a housing outlet. The air expelled from the housing outlet creates a vacuum in an outlet port of the drum for pulling air through the dryer for contacting the damp clothing tumbling in the drum. Depending on the drying cycle, a heating element, or heater, may be activated to heat the air before the air is drawn into the drum. The dry heated or unheated air circulates among the damp clothing causing water within the damp clothing to evaporate. As additional dry air is drawn into the drum, moisture laden air is extracted from the drum through an exhaust port of the drum via the blower. As would be readily understood by one skilled in the art, the blower may be adapted to blow air into the drum opposite as described above.

As noted above, the angular velocity of the motor output shaft is typically dictated by the number of motor poles and the electricity source frequency. With this relatively fixed value, a transmission system (e.g., a pulley) is used to produce a drum angular velocity suitable to tumble an average load of clothing. For instance, the dryer may have a two (2) pole line frequency electric motor coupled to a sixty (60) hertz ("Hz") power supply in North America. This motor is configured to have an unloaded output shaft angular velocity of approximately 3,600 rotations per minute ("rpm"). Even with a transmission system, however, size constraints prevent this motor from reliably rotating a drum. Specifically, because the output shaft angular velocity must be reduced in order to rotate the drum at a preferred angular velocity, a transmission member having a very small diameter must be coupled to the output shaft and a comparatively larger transmission member must be coupled to drum. A power transmission device, such as an endless belt, is used to couple the rotation of the small diameter transmission member on the output shaft to the larger transmission member coupled to the drum. In order to achieve a preferred drum angular velocity; however, the transmission member coupled to the output shaft may be too small to engage reliably the endless belt. Furthermore, when the blower is driven at 3,600 rpm it may operate at a noise level that some users find objectionable.

To address this problem, clothes dryers may include a four (4) pole line frequency electric motor coupled to a sixty (60) Hz power supply. This motor is configured to have an unloaded output shaft angular velocity of approximately 1,800 rpm. An angular velocity of 1,800 rpm may be faster than a preferred angular velocity of the drum; however, the reduced angular velocity of the output shaft (as compared to a two (2) pole line frequency electric motor) enables a preferred drum angular velocity to be attained with a larger output shaft transmission member, which engages an endless belt or other power transmission device more reliably. An angular velocity of 1800 rpm, however, may be too slow to drive the blower at a speed that produces a preferred amount of air flow. Therefore, a second transmission is required to convert the angular velocity of the output shaft to a preferred angular velocity for driving the blower. In summary, a four (4) pole line frequency electric motor may function to rotate both a drum and a blower of a clothes dryer; however, two transmissions are required to convert the angular velocity of the output shaft to preferred angular velocities for driving the blower and rotating the drum. Therefore, further developments in the area of clothes dryers having a single electric motor, are highly desirable.

SUMMARY

A drying device has been developed having a single electric motor configured to drive an air blower at a preferred angular velocity without requiring transmission components for rotation of the air blower or the clothes drum. The drying device includes a drum, a blower, and a non-line frequency electric motor. The drum is coupled to a support frame to enable rotation of the drum relative the support frame. The drum has an interior space for holding a load of articles, such as clothing. The blower is coupled to the support frame. The blower is configured to generate an air flow within the interior space of the drum in response to being driven by the electric motor. The non-line frequency electric motor is coupled to the support frame and is electrically coupled to a non-line frequency supply voltage. The electric motor has an output shaft that is connected directly to the blower to drive the blower and that is coupled to the drum to rotate the drum.

Another drying device has a variable speed electric motor configured to drive an air blower and rotate a clothes drum within a continuous range of angular velocities. The drying device includes a drum, a blower, a non-line frequency variable speed electric motor, and a controller. The drum is coupled to a support frame to enable rotation of the drum relative the support frame. The drum has an interior space for holding a load of articles, such as clothing. The blower is coupled to the support frame and configured to generate an air flow within the interior space of the drum in response to being driven by the variable speed electric motor. The non-line frequency variable speed electric motor includes an output shaft that is coupled at one end to the blower to drive the blower and that is coupled at another end to the drum to rotate the drum. The controller is electrically coupled to the electric motor and is configured to control at least an angular velocity of the output shaft to regulate the speed of the air blower.

Another drying device has a single electric motor coupled to a controller to enable a heater to be energized only in response to the electric motor rotating its output shaft. The drying device includes a drum, a blower, a heater, a non-line frequency electric motor, a sensing element, and a controller. The drum is coupled to a support frame to enable rotation of the drum relative the support frame. The drum has an interior space for holding a load of articles, such as clothing. The blower is coupled to the support frame and is configured to generate an air flow within the interior space of the drum in response to being driven by an electric motor. The heater is configured for being selectively coupled to a supply voltage to enable the heater to heat the air flow generated by the blower selectively. The non-line frequency electric motor is coupled to the support frame and electrically coupled to a non line-frequency supply voltage. The electric motor includes an output shaft configured to drive the blower and rotate the drum. The sensing element is configured to generate at least a shaft rotation signal in response to rotation of the output shaft. The controller is electrically coupled to at least the sensing element and the heater. The controller is configured to couple the heater to the supply voltage only in response to the sensing element generating the shaft rotation signal.

Another drying device has a bearing cap, which includes a guide surface for guiding an endless belt onto a belt engaging surface. The drying device includes a drum, a blower, an electric motor, and a bearing cap. The drum is coupled to a support frame to enable rotation of the drum relative the support frame. The drum has an interior space for holding a load of articles, such as clothing. The blower is coupled to the support frame and is configured to generate an air flow within the interior space of the drum in response to being driven by an electric motor. The electric motor includes an output shaft coupled to the blower to drive the blower. The bearing cap is mounted about the output shaft and includes a guide surface configured to guide an endless belt onto a belt engaging surface coupled to the output shaft. The endless belt is configured to couple rotation of the output shaft to the drum.

A method for modifying a drying device that tumble dries articles has been developed. The method includes decoupling a line frequency supply voltage from a drying device that has a motor unit, a drum, a blower, and a support frame. The motor unit, which has a line frequency electric motor, is removed from the support frame to expose a motor space. The method further includes coupling a motor assembly to the support frame that is configured to fit within the motor space. The motor assembly includes a non-line frequency electric motor that is electrically coupled to a controller. The line frequency supply voltage is coupled to the controller, which is configured to convert the line frequency supply voltage to a non-line frequency supply voltage. One end of an output shaft of the non-line frequency electric motor is coupled to the drum and another end of the output shaft of the non-line frequency electric motor is coupled to the blower. Thus, the non-line frequency electric motor is able to rotate the blower to generate an air flow through an interior space of the drum that is also rotated by the motor.

DETAILED DESCRIPTION

Figure 1:
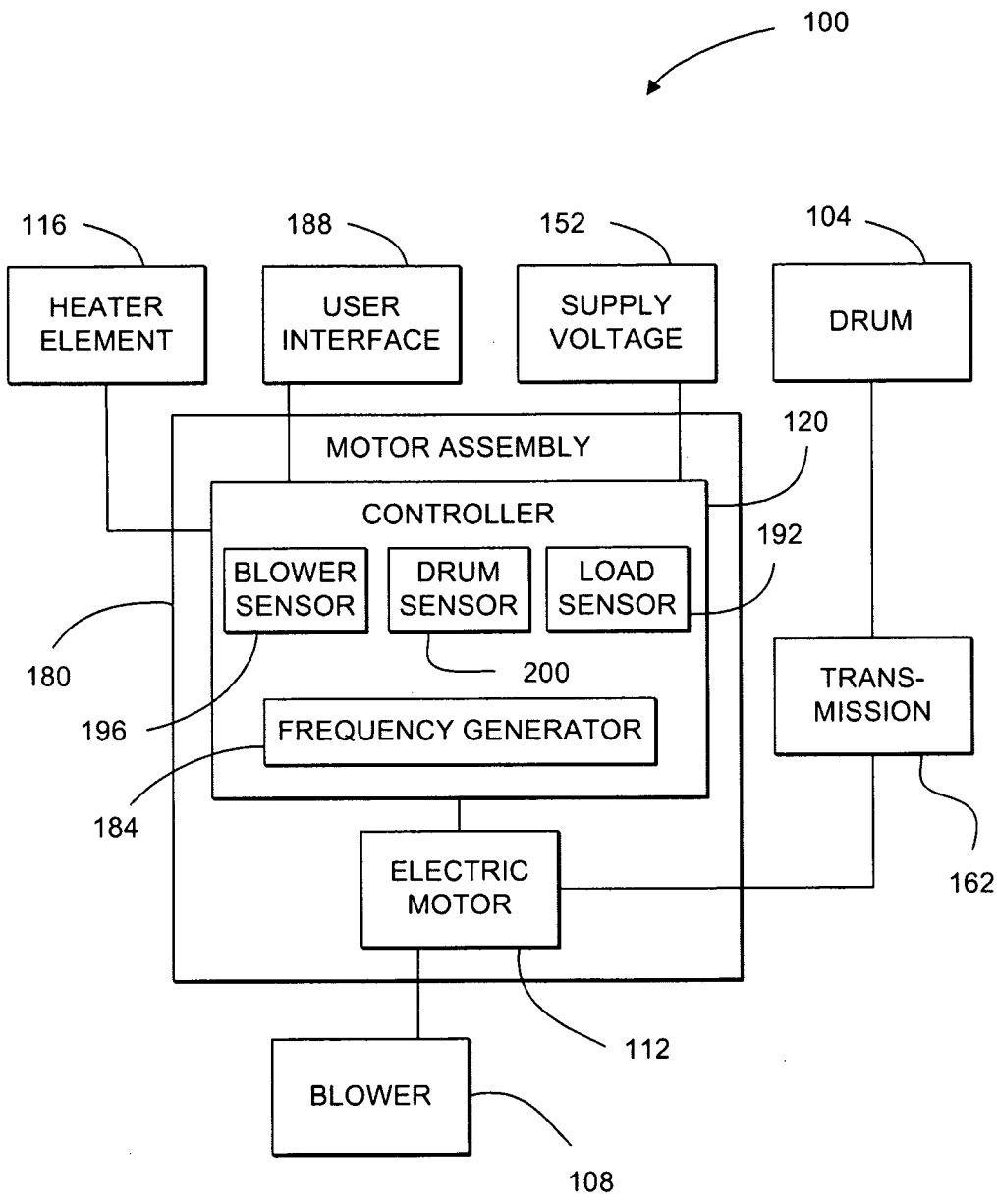
FIG. 1 is a block diagram depicting a dryer device as described herein.

Referring to FIG. 1, a block diagram of a drying device is shown. The drying device, referred to as a dryer 100, dries damp articles, such as clothing, by circulating dry air among the damp articles. The dryer 100 may include, a support frame (not illustrated), a drum 104, a blower 108, a non-line frequency electric motor 112, a heater 116, and a controller 120. The drum 104, as known in the art, is typically a generally cylindrically-shaped apparatus that is coupled to the support frame for rotation relative to the support frame. The drum 104 has an interior space for holding articles, such as clothing, to be dried. The blower 108, in response to being driven by the electric motor 112, circulates air into the drum 104 and among the articles. The heater 116 may be energized to heat the air circulated by the blower 108. The controller 120 may control an amount of air flow generated by the blower 108 as well as an angular velocity of the drum 104. Below, each element of the dryer 100 is explained in detail.

Figure 2:
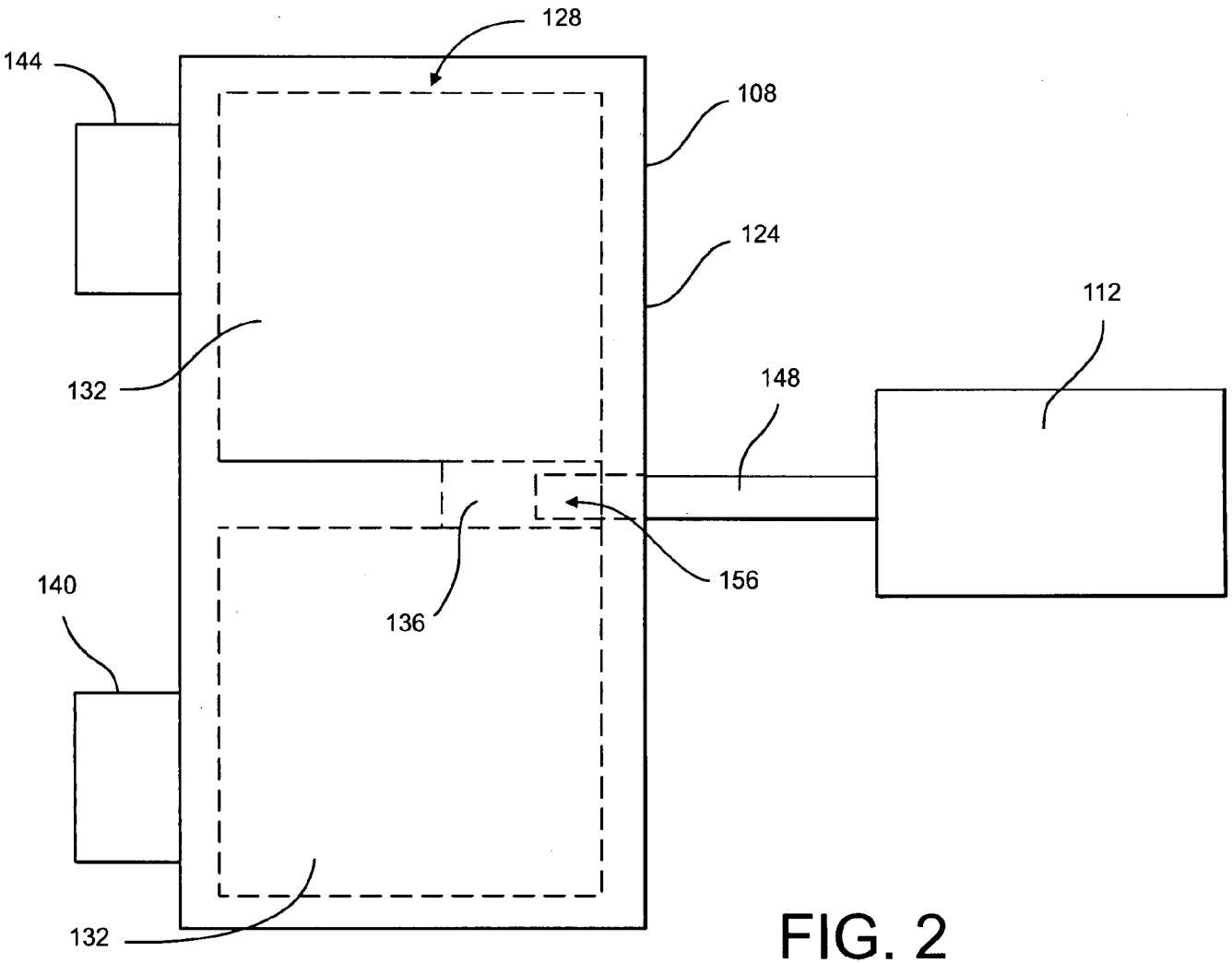
FIG. 2 is a cutaway plan view of a non-line frequency electric motor being directly connected to an air blower for use in the dryer device of FIG. 1.

The blower 108 generates an air flow through the drum 104 for drying the articles. As shown in FIG. 2, the blower 108 includes a housing 124 and a fan 128. The housing 124 may be fixedly coupled to the support frame. The fan 128 may be mounted for rotation within the housing 124. The fan 128 may include a plurality of fan blades 132 surrounding a blower shaft 136. When the blower shaft 136 is rotated, the fan blades 132 draw air into an inlet 140 and force air out of an outlet 144. Typically, the blower 108 generates an air flow related to the angular velocity of the fan 128. As also shown in FIG. 2, the blower 108 may be directly connected to an output shaft 148 of the electric motor 112.

The heater 116 is coupled to the support frame to heat the air flow generated by the blower 108 before the air flow enters the drum 104. When the heater 116 is coupled to a supply voltage 152 at least a portion of the heater 116 increases in temperature. By heating the air circulated among the damp articles in the drum 104, a drying time may be reduced. In some embodiments, the heater 116 may be heated by the combustion of a fuel, such as gas, instead of being coupled to the supply voltage 152. Suitable fuels include, but are not limited to, natural gas and liquid propane. The controller 120, as explained below, may control when the heater 116 becomes energized.

Figure 3:
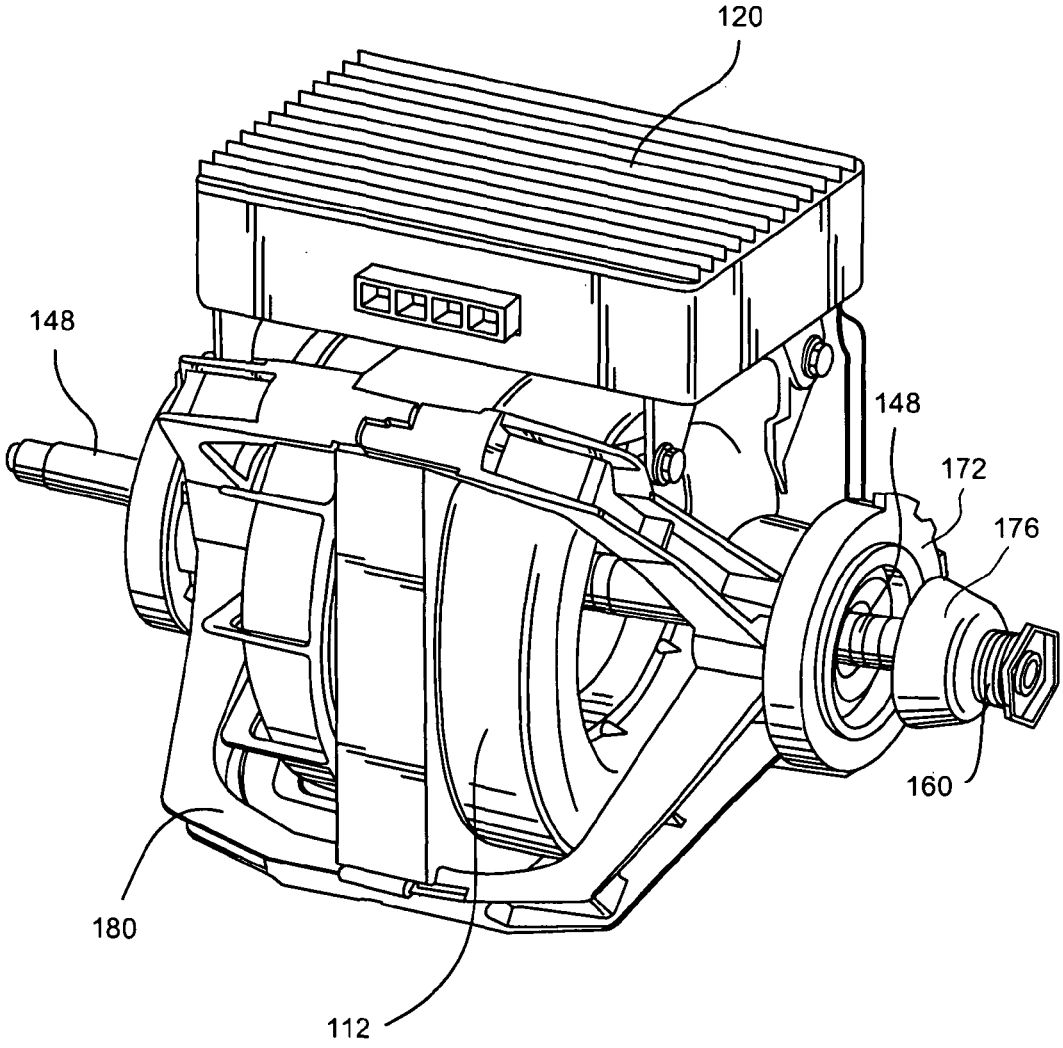
FIG. 3 is a perspective view of a motor assembly for use in the dryer device of FIG. 1.

The non-line frequency electric motor 112, one embodiment of which is shown in FIG. 3, drives the blower 108 and rotates the drum 104. As used herein, the term "line frequency" refers to the frequency of the alternating current or voltage generated by a power plant and distributed to residential and consumer customers over a power grid. For instance, in North America, the line frequency is approximately sixty (60) hertz ("Hz"). In much of Europe, however, the line frequency is approximately fifty (50) Hz. Accordingly, a "non-line frequency" electric motor 112 is an electric motor capable of generating a torque when coupled to an alternating current signal or alternating voltage signal having a frequency other than the line frequency. Exemplary electric motors 112 capable of functioning as non-line frequency electric motors 112 include, but are not limited to, three phase controlled induction motors, permanent magnet motors (brushed or brushless), switched reluctance motors, and universal motors. In contrast, electric motors configurable only as line frequency electric motors include, but are not limited to, split phase motors, permanent split capacitor motors, and shaded pole motors.

The output shaft 148 of the electric motor 112 rotates with an angular velocity suitable to be directly connected to the blower 108. In particular, because the electric motor 112 is a non-line frequency motor, the output shaft 148 can be controlled to rotate at an angular velocity between the output shaft angular velocities of a two (2) pole line frequency electric motor (3,600 rotations per minute ("rpm")) and a four (4) pole line frequency electric motor (1,800 rpm). Accordingly, the angular velocity of the output shaft 148 may eliminate the need for a transmission between the motor 112 and the blower 108. Additionally, the angular velocity of the output shaft 148 may be coupled to the drum 104 with an output shaft transmission member having a diameter configured to engage reliably an endless belt or other transmission device 162.

Referring now to FIG. 2, an exemplary connection between the output shaft 148 and the blower 108 is illustrated. As shown, the output shaft 148 may be inserted into an opening 156 in the blower shaft 136. When the output shaft 148 is inserted into the opening 156 the rotation of the output shaft 148 is coupled to the blower shaft 136 at a 1:1 ratio. Specifically, each complete rotation of the output shaft 148 results in a complete rotation of the fan 128 within the blower 108. The opening 156 and the output shaft 148 may be threadingly coupled together in embodiments of the dryer 100 having an electric motor 112, which rotates an output shaft 148 in only one direction. Embodiments of the dryer 100 having an electric motor 112, which rotates in two directions, may be directly connected in a manner that maintains a connection between the output shaft 148 and the blower 108 when the motor 112 rotates in either direction.

Figure 4:
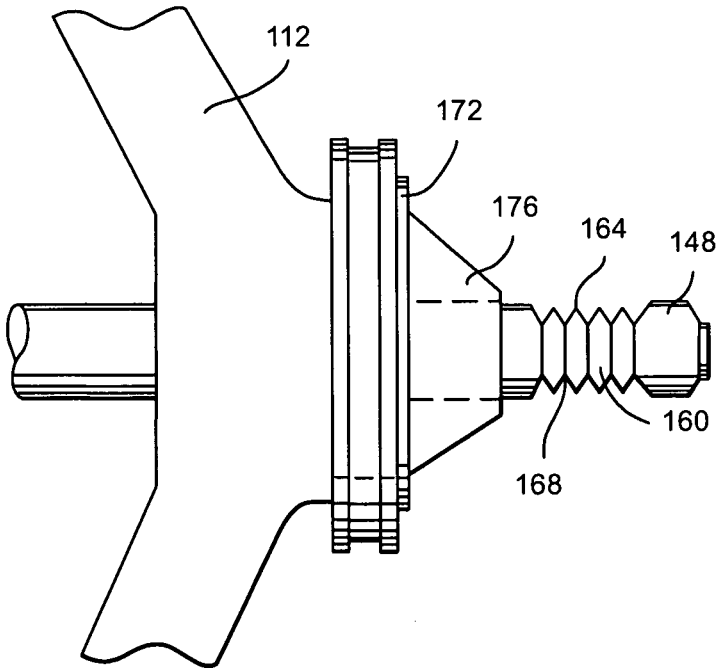
FIG. 4 is a plan view of an output shaft and a bearing cap of a non-line frequency electric motor for use in the dryer device of FIG. 1.

As shown in FIG. 3, the end of the output shaft 148 opposite the blower 108 includes a belt engaging surface 160 for coupling rotation of the output shaft 148 to the drum 104. As shown best in FIG. 4, the belt engaging surface 160 may be formed directly on the output shaft 148 of the electric motor 112, to eliminate the need to couple a separate transmission member to the output shaft 148. The belt engaging surface 160 may include numerous ribs 164 and valleys 168 for engaging an endless belt or other transmission device 162. The ribs 164 and valleys 168 are similar to the ribs and valleys found on known pulley wheels for engaging endless belts.

To ensure that an endless belt remains seated upon the belt engaging surface 160, the electric motor 112 may include a bearing cap 172 having a guide surface 176. Typically, a bearing cap 172 may be mounted about an output shaft 148 to support an output shaft bearing (not illustrated). In known dryers, pulley side surfaces normally keep endless belts seated upon a pulley, however, because the output shaft 148 may not be equipped with a pulley, there may not be side surface to guide the belt. Accordingly the bearing cap 172 has been modified to include a guide surface 176. The reader should note that the bearing cap 172 and guide surface 176 do not prohibit a transmission member from being coupled to the output shaft 148.

Referring again to FIG. 3, the electric motor 112 and the controller 120 may be coupled together to form a motor assembly 180. The motor assembly 180 may be coupled to a dryer 100 in a single unit to simplify assembly of the dryer. Additionally, as explained below, the motor assembly 180 may replace another motor assembly in an existing dryer. In particular, the motor assembly 180 may replace a nonfunctional electric motor in an existing clothes dryer. Also, the motor assembly may replace a functional electric motor in an existing clothes dryer to modify the drying performance of the clothes dryer by rotating the blower 108 with an increased angular velocity.

The controller 120 of the motor assembly 180 controls at least an angular velocity of the output shaft 148 of the electric motor 112. As shown in FIG. 1, the controller 120 may be coupled to a line frequency supply voltage 152. The controller 120 includes a frequency generator 184, as is known in the art, for converting the line frequency supply voltage 152 into a non-line frequency motor voltage for driving the electric motor 112. As previously noted, in North America the supply voltage 152 typically has a frequency of approximately sixty (60) Hz. The frequency generator 184, by way of non-limiting example, may generate a motor voltage having a frequency of ninety (90) Hz, suitable to drive a four (4) pole non-line frequency electric motor 112 at an unloaded angular velocity of 2,700 rpm.

The frequency generator 184 may also generate a motor voltage having a continuously variable frequency. For instance, by way of non-limiting example, the frequency generator 184, may generate a motor voltage having a frequency, which ranges continuously from approximately zero (0) Hz to five hundred (500) Hz. The variable frequency motor voltage generated by the controller 120 may be coupled to a non-line frequency variable speed electric motor 112 for controlling the angular velocity of the output shaft 148 of the electric motor 112 within a predetermined range. Such a controller may gradually increase the angular velocity of the output shaft 148 to provide a "soft start" feature for the dryer 100. Often, when a drying cycle begins, the electric motor of a dryer is coupled to a voltage signal that causes a motor output shaft 148 to increase in angular velocity very quickly. The abrupt increase in angular velocity may stress belts and other transmission members coupled to the electric motor. To minimize stress upon transmission members the controller 120 may increase slowly the angular velocity of the output shaft 148 of a variable speed motor 112 by regulating the ratio of the amplitude and frequency of the power signal provided to the motor in response to a dryer start signal. An exemplary manner of increasing slowly the angular velocity is to increase gradually the frequency of the motor voltage with the frequency generator 184 from lower frequency to a higher operating frequency. An exemplary soft start cycle may require several seconds in order to bring the output shaft 148 from zero (0) angular velocity to an operational angular velocity. The soft start of the output shaft 148 minimizes stress upon belts, transmission members, and also motor mounts (not illustrated), which secure the motor assembly 180 to the support frame of the dryer 100.

The controller 120 may also increase or decrease the angular velocity of the output shaft 148 to control an amount of air flow produced by the blower 108 and to control precisely the angular velocity of the drum 104, compensating for any slippage of the motor from synchronous speed. For instance, some embodiments of the controller 120 may be coupled to a user interface 188 having one or more input devices for selecting a high load or a low load. When operated in a low load mode, such as with fewer or lighter clothes, the controller 120 may generate a motor voltage having a comparatively lower frequency in order to rotate the motor more slowly than normal because with reduced load, the motor will tend to rotate nearer to synchronous speed. When operated in high load mode, the controller 120 may generate a motor voltage having a comparatively higher frequency in order to rotate the motor more quickly than normal, because with increased load, the motor will tend to rotate further below synchronous speed. These modes are utilized to correct for motor slippage from the preferred drum speed due to loading. Additionally, the user interface 188 may include an input device for selecting a dryer speed along a continuous range of loads. Because the blower fan 128 and the drum 104 are driven by the same electric motor 112, the blower airflow and the drum speed may not be independently controlled in this embodiment.

A load sensor 192 may be included in the controller 120 for determining the present load on the motor, which relates to the mass of clothing within the drum 104. The load sensor 192 generates a signal indicative of the load on the motor. The controller 120 may adjust the angular velocity of the output shaft 148 in response to the signal generated by the load sensor 192. For instance, if the load sensor 192 indicates a comparatively massive load has been placed in the drum 104, the controller 120 may adjust the speed of the drum 104 and the blower 108 to ensure the preferred speed of the drum is maintained regardless of load. As shown in FIG. 1, the load sensor 192 in some embodiments is not coupled to the drum 104. Accordingly, the load sensor 192 may determine the mass of a load in the drum 104 by detecting, among other quantities, the angular velocity of the electric motor 112 and/or by the current drawn by the motor 112.

The controller 120 may also include a blower sensor 196 for determining if the blower 108 is generating an air flow. In order to detect a dryer 100 failure, the controller 120 may monitor the air flow from the blower 108. Specifically, the blower sensor 196 may generate a signal indicating the blower 108 is generating an air flow. If the signal indicates that the blower 108 is generating an air flow, the controller 120 may selectively couple the heater 116 to the supply voltage 152. If, however, the signal indicates that the blower 108 is not generating an air flow, the controller 120 may not couple the heater 116 to the supply voltage 152. Additionally, when the blower sensor 196 generates a signal indicating the blower 108 is not generating an air flow, the controller 120 may energize an enunciator indicating that the dryer 100 has experienced a fault and should be professionally serviced by a trained technician.

A drum sensor 200 may be included in the controller 120 for determining if the drum 104 is rotating. The drum sensor 200 generates a signal indicative of the rotation of the drum 104. When the signal indicates that the drum 104 is rotating, the dryer 100 may function normally. When the output shaft 148 of the electric motor 112 is rotating and the signal indicates that the drum 104 is not rotating, however, the controller 120 will not couple the heater 116 to the supply voltage 152 and will turn off the motor 112, because the drum 104 is not rotating. Additionally, when the drum sensor 200 generates a signal indicating the drum 104 is not rotating, the controller 120 may energize an enunciator indicating that the dryer 100 has experienced a fault and should be professionally serviced by a trained technician. For example, a drum 104 may not rotate due to a broken endless belt or a locked or frozen drum, among other reasons.

The controller 120 may operate the drum 104 and the electric motor 112 in a first and a second direction. In response to the electric motor 112 operating in a first direction, the drum 104 tumbles articles within the drum in one direction. In response to the electric motor 112 operating in a second direction, the drum 104 tumbles articles within the drum in the opposite direction, for controlling the movement of articles within the rotating drum 104, such as for reducing tangling and wrinkling of the articles. The user interface 188 may include an input device allowing a user to select one or more drum rotation options. Additionally, the controller 120 may be configured to alternate automatically between the forward and reverse drum rotation, depending on the drying cycle.

Figure 5:
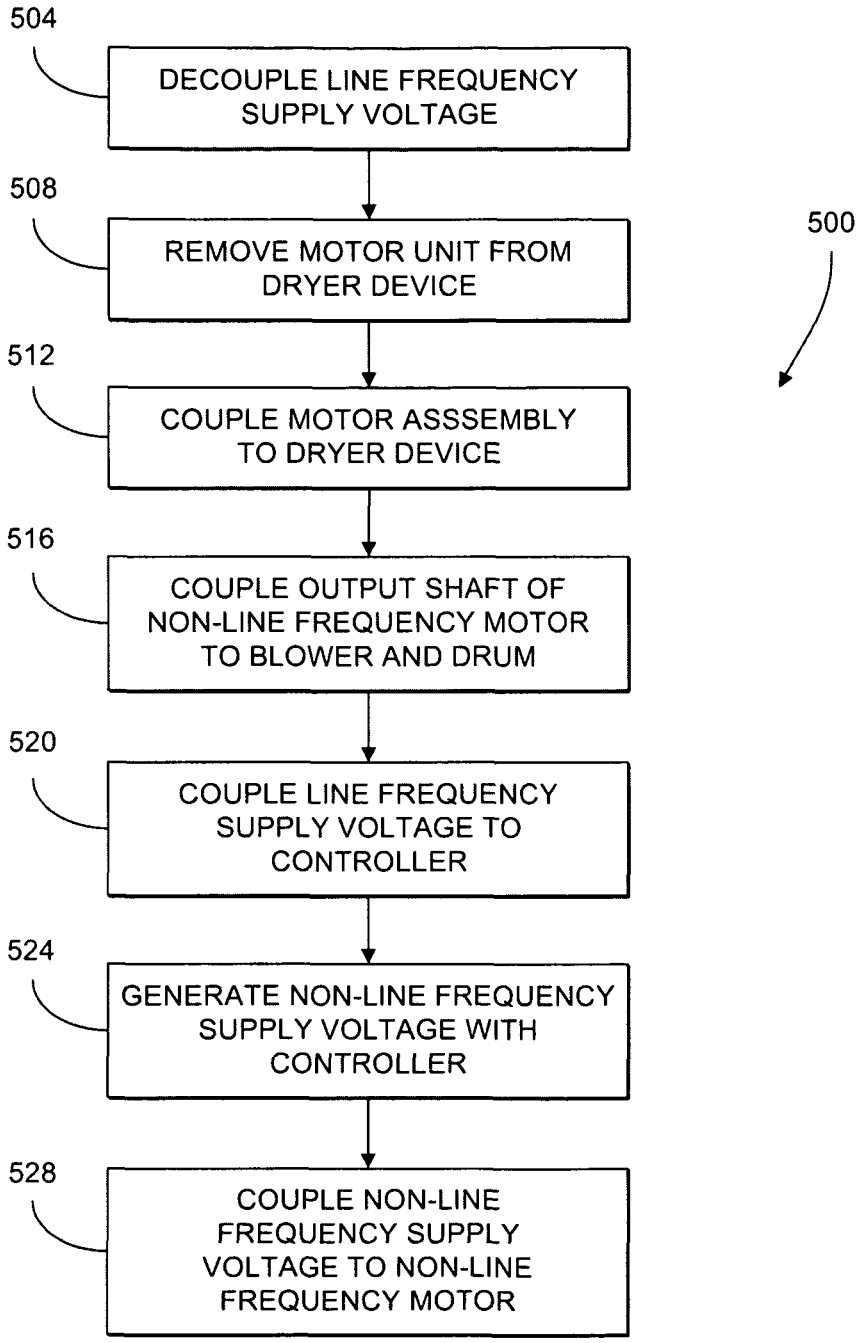
FIG. 5 is a flow chart depicting a method of operating the drying device of FIG. 1.

The dryer 100 components illustrated in FIG. 1 implement a method 500 of controlling a dryer as illustrated by the flow chart of FIG. 5. In particular, the method 500 configures a dryer originally designed to operate with a line frequency electric motor to function with a non-line frequency motor assembly 180. The motor assembly 180 may replace a defective line frequency electric motor. Alternatively, the motor assembly 180 may replace an operative line frequency motor to increase the angular velocity of the blower fan 128 and modify drying performance. As shown in step 504 of FIG. 5, a line frequency supply voltage 152 may be decoupled from the dryer. Next, as shown in step 508, a line frequency electric motor or line frequency electric motor unit may be removed from dryer to expose a motor space (not illustrated). The motor space is a volume within the bounds of a dryer support frame formerly occupied by a line-frequency electric motor or a line frequency electric motor unit.

Next, as shown in step 512 of FIG. 5, the motor assembly 180 may be coupled to the support frame of the dryer. The motor assembly 180 is sized to fit within the motor space of many types of dryers. Accordingly, the motor assembly 180 may be utilized in dryers from multiple manufacturers and distributors. As shown in step 516, the output shaft 148 of the non-line frequency electric motor 112 of the motor assembly 180 may be coupled to the existing blower 108 and existing drum 104 of the dryer. Depending on the embodiment, the output shaft 148 may be directly connected to the blower 108 in order to generate an increased air flow as described above. Alternatively, the output shaft 148 may be coupled to an existing transmission to drive the blower 108. The output shaft 148 may include a belt engaging surface 160 formed directly on the output shaft 148 for engaging an endless belt coupled to the drum 104.

After the output shaft 148 of the non-line frequency motor 112 has been coupled to the blower 108 and the drum 104, the line frequency supply voltage 152 may be coupled to the dryer. In particular, as shown in step 520 of FIG. 5, the line frequency supply voltage 152 may be coupled to the controller 120. Next, as shown in steps 524 and 528 of FIG. 5, the controller 120 may generate a non-line frequency motor voltage, which is coupled to the electric motor 112 to drive the output shaft 148 of the electric motor 112, as described in detail above. In some exemplary embodiments the motor voltage generated by the controller 120 has a three phase voltage signal, although other numbers of phases may be utilized without departing from the scope of the invention. The method 500, therefore, utilizes the "drop-in" capabilities of the motor assembly 180 either to repair or to upgrade an existing dryer 100.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drying device for tumble drying articles, the drying device comprising:

a drum coupled to a support frame to enable rotation of the drum, the drum having an interior space;

a blower coupled to the support frame, the blower being configured to generate an air flow within the interior space of the drum in response to being driven by an electric motor;

a blower sensor configured to generate a signal indicative the blower is generating air flow;

a non-line frequency electric motor coupled to the support frame, the electric motor having an output shaft with a first and a second end, the first end of the output shaft being connected directly to the blower to drive the blower and the second end is coupled to the drum to rotate the drum;

a load sensor configured to generate a signal indicative of a load on the non-line frequency electric motor;

a frequency generator that is electrically connected to a voltage source to receive a voltage having a line frequency and is electrically connected to the non-line frequency electric motor, the frequency generator being configured to generate a non-line frequency voltage; and a controller operatively connected to the frequency generator, the blower sensor, and the load sensor, the controller being configured to operate the frequency generator to control an angular velocity of the output shaft of the electric motor with reference to the signal generated by the load sensor and to energize an enunciator in response to the signal from the blower sensor indicating the blower is not generating air flow.

2. The drying device of claim 1, the blower further comprising:

a fan member connected directly to an end of the output shaft, the fan member configured to rotate within a blower housing at an angular velocity that is equal to an angular velocity of the output shaft.

3. The drying device of claim 1, the output shaft being configured to rotate in both a clockwise and a counterclockwise direction and the drum being configured to rotate in the clockwise and the counterclockwise directions in response to rotation of the output shaft.

4. The drying device of claim 1, further comprising:

a belt engaging surface rotatable with the output shaft of the electric motor, the belt engaging surface configured to engage an endless belt, and the endless belt being configured to couple rotation of the output shaft to the drum.

5. The drying device of claim 1, the electric motor being one of a three phase controlled induction motor, a permanent magnet motor, a switched reluctance motor, and a universal motor.

* * * * *